US008839654B2

(12) United States Patent
Erlenmaier

(10) Patent No.: US 8,839,654 B2
(45) Date of Patent: Sep. 23, 2014

(54) PUNCH PRESS OSCILLATING TOOL INSERT

(75) Inventor: Werner Erlenmaier, Garlingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 13/164,304

(22) Filed: Jun. 20, 2011

(65) Prior Publication Data

US 2011/0308294 A1 Dec. 22, 2011

Related U.S. Application Data

(63) Continuation of application No. PCT/EP2009/008767, filed on Dec. 8, 2009.

(30) Foreign Application Priority Data

Dec. 22, 2008 (EP) ..... 08022324

(51) Int. Cl.
*B21D 37/00* (2006.01)
*B44B 5/00* (2006.01)
*B21D 28/20* (2006.01)

(52) U.S. Cl.
CPC ..... *B21D 28/20* (2013.01); *B44B 5/0004* (2013.01)
USPC ..... 72/481.1; 83/528; 72/74

(58) Field of Classification Search
USPC ..... 72/456, 481.1, 481.2, 74, 710, 449; 101/10, 20, 65, 94; 29/56; 83/527, 528; 234/111–116; 74/22 A, 25, 56; 33/18.1, 33/1 M
See application file for complete search history.

(56) References Cited

U.S. PATENT DOCUMENTS

| | | | | |
|---|---|---|---|---|
| 3,707,087 | A * | 12/1972 | Neilsen | 72/429 |
| 3,842,634 | A * | 10/1974 | Matsuoka | 72/142 |
| 4,089,204 | A * | 5/1978 | Neilsen | 72/412 |
| 5,682,657 | A | 11/1997 | Hirose | |
| 2001/0029849 | A1 * | 10/2001 | Yano et al. | 101/3.1 |
| 2001/0042453 | A1 | 11/2001 | Schneider | |
| 2007/0000299 | A1 | 1/2007 | Kuno | |
| 2007/0101840 | A1 | 5/2007 | Schmauder | |

FOREIGN PATENT DOCUMENTS

| | | | |
|---|---|---|---|
| CN | 101035637 | A | 9/2007 |
| CN | 200957695 | Y | 10/2007 |
| CN | 101088702 | A | 12/2007 |
| DE | 8526360 | U1 | 12/1985 |
| DE | 19949552 | C1 | 2/2001 |

(Continued)

OTHER PUBLICATIONS

Notification Concerning Transmittal of International Preliminary Report on Patentability and Written Opinion for corresponding PCT Application No. PCT/EP2009/008767, mailed Jul. 7, 2011, 7 pages.

(Continued)

*Primary Examiner* — Shelley Self
*Assistant Examiner* — Matthew G Katcoff
(74) *Attorney, Agent, or Firm* — Fish & Richardson P.C.

(57) ABSTRACT

In certain aspects of the invention, punching machines and tools for punching machines are provided that include mechanical devices driven by a driving device of the punching machines and are used to oscillate a tool insert. Such machines and tools can provide an increased frequency of the oscillating movement of the tool insert.

15 Claims, 4 Drawing Sheets

(56) References Cited

FOREIGN PATENT DOCUMENTS

| | | | |
|---|---|---|---|
| GB | 2439192 | A | 12/2007 |
| JP | 8183296 | A | 7/1996 |
| JP | 8281340 | A | 10/1996 |
| JP | 2000296483 | | 10/2000 |
| JP | 2007008133 | | 1/2007 |

OTHER PUBLICATIONS

Office Action from corresponding Chinese Application No. 200980152124.9, mailed Feb. 5, 2013, with English translation, 14 pages.

International Search Report from corresponding PCT Application No. PCT/EP2009/008767, mailed Feb. 12, 2010, 3 pages.

* cited by examiner

PUNCH PRESS OSCILLATING TOOL INSERT

CROSS-REFERENCE TO RELATED APPLICATIONS

This application is a continuation of, and claims priority under 35 U.S.C. §120 to, PCT Application No. PCT/EP2009/008767, filed on Dec. 8, 2009, which claimed priority to European Patent Application No. 08 022 324.1, filed on Dec. 22, 2008. The contents of both of these priority applications are hereby incorporated by reference in their entirety.

FIELD OF THE INVENTION

The invention relates to tooling for punch press machines.

BACKGROUND

Often, sheet metal parts are manufactured to include certain marks, such as company logos, part numbers, dates (e.g., the date of manufacturing), material information, symbols for mounting, and/or other marks. When manufacturing sheet metal parts using a punching press, the marks may be applied to the part by the punching press itself.

The sheet metal parts can be marked by a hob having a shape corresponding to the desired embossed mark to be applied to the part, and the mark can be impressed in the sheet metal by a single machining stroke. However, since this process for applying marks can consume a significant amount of operating time of the hob used to apply the desired mark, flexibility can be limited.

Another way to apply a mark to a sheet metal part is to impress a series of dots (e.g., a grid of dots) in a desired pattern to create the appearance of the desired mark. The pattern of dots can be applied dot by dot using a marking pin to imprint the sheet metal. Typically, the dots are separated by distances small enough that the desired pattern appears as a line or a web. In order to create a pattern of dots that appear as a web, it can be necessary to imprint a large number of dots into the sheet metal.

These processes of applying marks to sheet metal parts generally involve a stamp having a tapered tip disposed in an upper tool holding fixture. The upper tool holding fixture is typically oscillated by an upper tool holding fixture drive. When the tip impinges on the surface of the sheet metal, a dot-shaped indentation having a depth of few tenths of a millimeter is indented in the metal sheet. The frequency of the strokes is typically limited to 2800 to 3000 strokes/minute by conventional drive techniques due to the high masses of the drives.

SUMMARY

In certain aspects of the invention, a tool for a punching machine includes an oscillating drive mechanism that has a lower mass than conventional drive mechanisms of punching machines. The oscillating drive mechanism can move a marking pin in an axial direction. By using an oscillating drive mechanism having a relatively low mass, higher stroke frequencies and therefore faster marking times (i.e., reduced fabrication time) can be achieved. As a result, in some embodiments, the tool can increase the speed with which dots can be created, and can thus increase the availability of the punching machine to be used for other production needs.

The details of one or more embodiments of the invention are set forth in the accompanying drawings and the description below. Other aspects, features, and advantages of the invention will be apparent from the description and drawings, and from the claims.

DETAILED DESCRIPTION OF THE INVENTION

Figure 1:
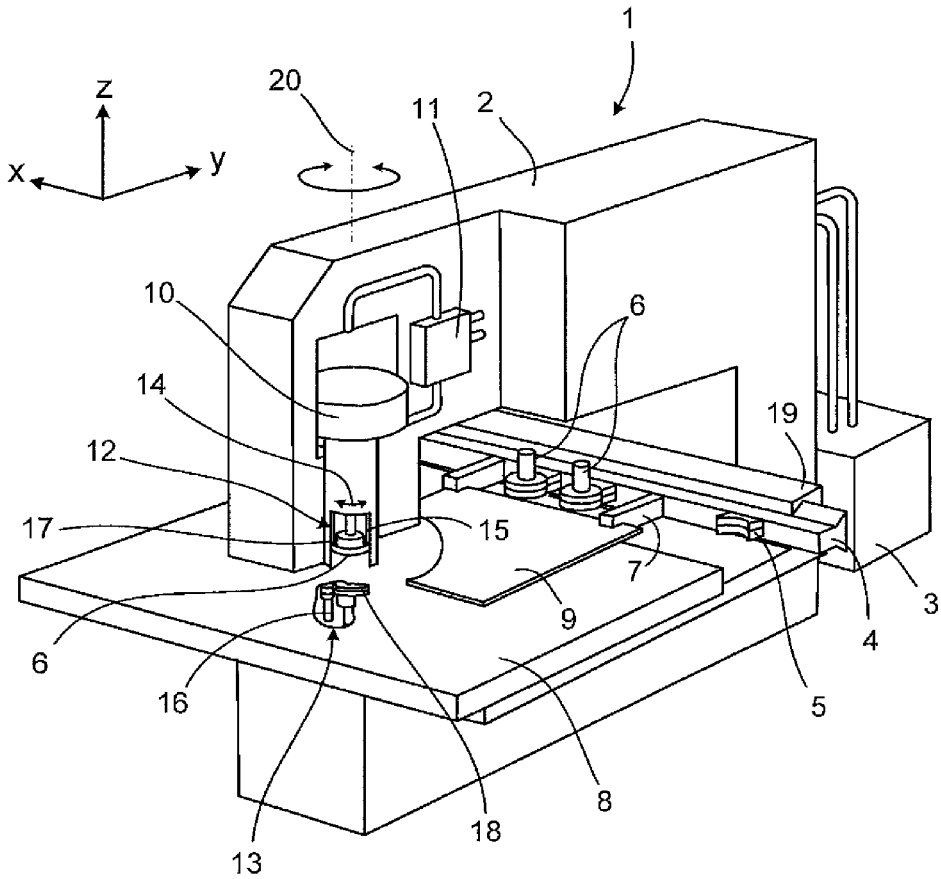
FIG. 1 is a schematic diagram illustrating a perspective view of a punching machine with a tool.

FIG. 1 is a schematic diagram illustrating a perspective view of a punching machine 1 with a tool. The punching machine 1 includes a C-shaped frame 2. The C-shaped frame 2 has a torsional stiff steel welded construction. As shown, a hydraulic power unit 3 is positioned at a rear portion of the C-shaped frame 2.

The punching machine 1 includes a machine controller (not shown) that can be contained in a separate housing. The machine controller is connected to actuators of the punching machine 1 and can control their movements. In some embodiments, the machine controller includes a keyboard to enable a user to input information and a monitor that can output data to be viewed by the user. The control functions of the actuators can be controlled by micro controllers, and processing programs and operation parameters are stored electronically in a storage device of the machine controller.

In the embodiment shown, a cross rail 4 with a guide 19 for the cross rail 4 is positioned at a lower, inner portion of the C-shaped frame 2. The cross rail 4 includes a tool magazine 5 in which tools (e.g., punch tools) 6 are mounted and clamping claws 7 mounted to the cross rail 4 along a side surface that faces front region of the punching machine 1 (e.g., the region where a workpiece is machined). A table 8 can also be connected to the guide 19 to move with the cross rail 4.

The clamping claws 7 can retain a workpiece (e.g., a sheet metal workpiece) 9 to be processed. The clamping claws 7 can be arranged at suitable positions along the cross rail 4 so that the sheet metal workpiece 9 is safely retained but is not gripped at positions where machining shall be conducted. Depending on the size of the sheet metal workpiece 9, the cross rail 4 includes a suitable number (e.g., two) of clamping claws 7 to properly grip the sheet metal workpiece 9. In some embodiments, more or fewer than two clamping claws 7 may be used (e.g., 1, 3, 4, 5, 10, or more).

As shown in FIG. 1, in a front, upper region of the C-shaped frame 2, the punching machine 1 includes a ram 10. The ram 10 is connected to a ram controller 11 that is connected to the machine controller. The ram 10 includes an upper rotary drive 14 which can rotate the ram 10 about its vertical axis 20.

At a lower end, the ram 10 includes an upper tool holding fixture 12 in which an upper portion 17 of one of the tools 6 can be received and held in a form-fit and backlash-free manner. The first upper rotary drive 14 can rotate the upper tool holding fixture 12 and enable locking in any desired angular position. The machine tool 1 also includes a locking device 15 for locking only one part of the upper portion 17 of the tool. During operation, some portions of the tools are selectively locked while others are allowed to rotate to produce oscillating motion, as discussed in detail below.

A lower tool holding fixture 13 is arranged in a front, lower region of the C-shaped frame 2. In some embodiments, the central axis of the lower tool holding fixture 13 is positioned along the same axis as the vertical axis 20 of the ram 10. The lower tool holding fixture 13 includes a lower rotary drive 16 to rotate the lower tool holding fixture 13 and enable locking of the lower tool holding fixture 13. In some cases, the rotary drive 16 enables locking of the lower tool holding fixture 13 in any desired angular position. A lower portion 18 of the tool 6 can be received and accommodated in the lower tool holding fixture 13.

In some embodiments, during operation of the punching machine 1, the sheet metal workpiece 9 is positioned for machining processes such that the table 8 can travel in an X-direction (shown in FIG. 1) together with the cross rail 4 and clamping claws 7 coupled along the guide 19. However, the table 8 typically does not travel in a Y-direction (shown in FIG. 1) with the cross rail 4 and/or clamping claws 7 as they move in the Y-direction. Therefore, in such embodiments, the sheet metal workpiece 9 can slide relative to the table 8 in the Y-direction and scratching of the sheet metal workpiece 9 can be prevented by suitable devices, such as movable balls (e.g., roller bearings) or brush bars. Translation of the cross rail 4 (and therefore the translation of the sheet metal workpiece 9) can be achieved by linear drives (e.g., electromechanical linear actuators) (not shown) controlled by the machine controller.

The machining process (e.g., the punching process) can be initiated after the sheet metal workpiece 9 is positioned so that the region of the sheet metal workpiece 9 to be machined is in the area of the axis 20. To begin the punching process, the ram 10 moves a stroke distance downward which may be the maximum stroke of the ram 10 or a stroke which is shorter than the maximum stroke of the ram 10. After traveling a stroke distance that is shorter than the maximum stroke, the ram 10 can move either upward or downward to a further predetermined position and then can resume travel to its upper end position. Subsequently, the sheet metal workpiece 9 is moved to a next position to undergo a next machining process.

Figure 2A:
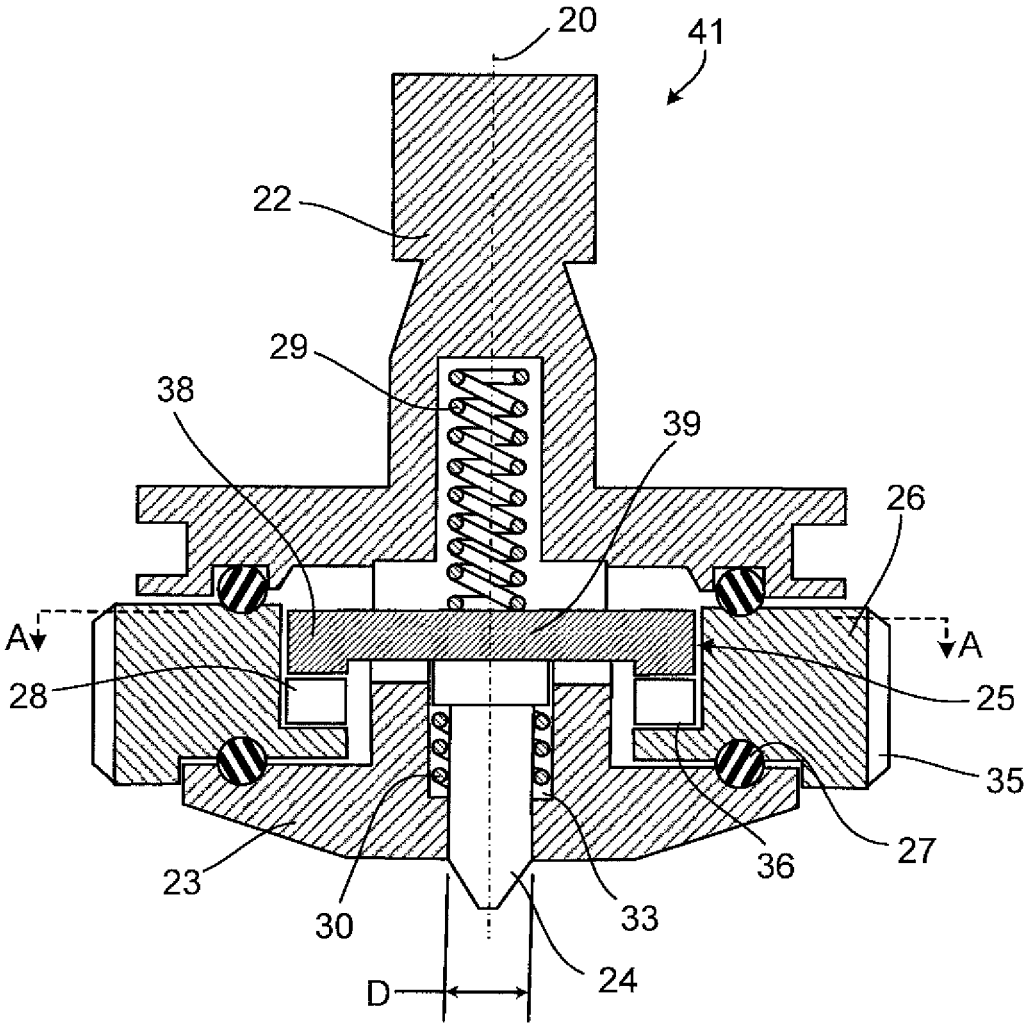
FIG. 2*a* is a schematic diagram illustrating a cross-sectional view of a part of the tool with an oscillating tool insert.

FIG. 2*a* shows an embodiment of a tool 41 having a central axis that corresponds to the axis 20 during use. The tool 41 includes a punch shaft 22 at an upper end. The punch shaft 22 is cylindrical and includes a frusto-conical recess so that the punch shaft 22 can be received in the upper tool holding fixture 12 of the punching machine 1 (shown in FIG. 1) in a form-fit and backlash-free manner. At its lower end, the punch shaft 22 includes a disc-shaped portion. At the bottom surface of the disc-shaped portion, a circular track with a semi-circular cross section is formed around a center axis of the disc-shaped portion to provide a rolling surface for multiple first rolling elements 27. In the center of the punch shaft 22, a cylindrical recess extends starting from the bottom of the disc-shaped portion upward into the punch shaft 22.

Figure 2B:
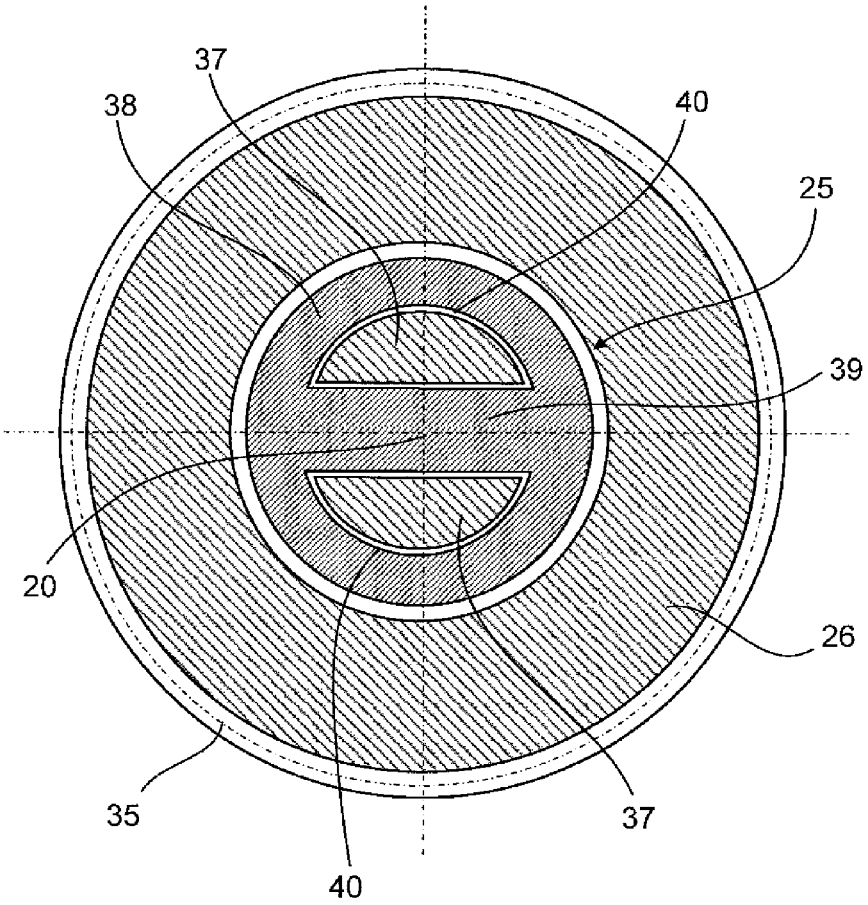
FIG. 2*b* is a schematic diagram illustrating a cross-section taken at A-A through the part of the tool shown in FIG. 2*a;*

A tool guide 23 is connected to the punch shaft 22. The tool guide 23 includes a plate-shaped portion at its lower end that has a circumferential circular track along an upper surface of the plate-shaped portion about the axis 20. On the upper surface of the plate-shaped portion, the plate-shaped portion includes a centrally positioned upwardly extending portion that has a hollow cylinder 33 along its central axis. At its upper end, the upwardly extending portion includes a slot. Referring briefly to FIG. 2*b*, the slot can pass parallel to the plate-shaped portion through the axis 20 so that, when viewed from above in the direction of the axis 20, two semi-circular annulus portions 37 extending upwardly are provided. Referring back to FIG. 2*a*, the hollow cylinder 33 includes a cylindrical recess extending in the plate-shaped portion so that a shoulder is formed at the lower end of the cylindrical recess. The outer diameter of the shoulder is limited by the inner wall of the hollow cylinder 33 and the inner diameter of the shoulder is limited by a circular orifice with a diameter D formed in the tool guide 23 at its lower portion.

The diameter D of the tool guide 23 is typically determined by the diameter of a tool insert 24 to be inserted therein. In some embodiments, the tool insert 24 is pin-shaped including a lower end designed to machine the sheet metal workpiece 9 and an upper end having a diameter which is enlarged to travel within, and be retained by, the smaller diameter of the shoulder. The diameter of the lower portion of the tool insert 24 is sized accordingly to the diameter D such that a friction bearing for axial movement is created. The tool insert is made of suitable materials for this application.

In some embodiments, the tool 41 includes a drive mechanism to convert rotary movement of a portion of the tool into an axial oscillating movement of the tool insert. In some embodiments, the drive mechanism includes a transmission element 25, an element 26 with a circumferential surface that is not flat or uniformly even but instead is an undulating surface including periodic hills and recesses, and an element 28 which is arranged between the transmission element 25 and the surface with the hills and recesses.

At the upper end, the tool insert 24 can abut the transmission element 25. As shown in FIG. 2*b*, when viewed in the direction of the axis 20, the transmission element 25 includes a circumferential annulus 38 and a centrally passing web 39, whereby two segment-like notches 40 that are positioned opposite the centrally passing web are formed. The transmission element 25 is inserted into the tool 41 such that its web 39 is able to move up and down in a slot formed by two annulus portions 37 in the hollow cylinder 33 of the tool guide 23. Similarly, the segment-like notches 40 are sized sufficiently to allow the two cylindrical annulus portions 37 of the tool guide 23 to pass through the transmission element 25. The annulus 38 has a thickness such that very little deformation or vibration occurs during operation. At the outer circumferential rim, a downwardly extending shoulder is provided, the bottom side of the shoulder serving as a running surface.

As shown in FIG. 2*a*, an element 26 with a circumferential surface that is not uniformly even but includes periodical hills and recesses (i.e., an undulating surface) is provided in the form of a hollow wheel between the punch shaft 22 and the tool guide 23. The hollow wheel 26 includes a circumferential gearing 35 on its outer circumferential surface that can be used to rotate the hollow wheel 26. The hollow wheel 26 includes a shoulder 36 on its inside surface between an inner circular interconnected orifice having a predetermined diameter and a cylindrical recess with a diameter that is larger than the predetermined diameter of the inner orifice. An annulus surface can radially extend between the predetermined diameter of the inner orifice and the larger cylindrical recess diameter. However, this annulus surface is typically not flat or even, but includes an active area in the form of a surface having hills and recesses positioned at different locations radially around the active area. These hills and recesses are formed in the hollow wheel 26 in the shape of a wave washer including multiple hills or recesses (e.g., six to ten hills and six to ten recesses), depending on the desired transformation ratio of the rotational speed into the stroke frequency. In some cases, the hills and recesses are located at evenly distributed angular distances from each other around the annulus surface. The height difference between the hills and the recesses of the hollow wheel 26 is approximately 1 mm in the direction of the axis 20.

Instead of being formed directly onto the hollow wheel 26, the hills and recesses can be formed by using a wave washer inserted in the shoulder of the hollow wheel 26. In such embodiments, the wave washer can be secured to the hollow wheel 26 to prevent inadvertent rotation of the wave washer relative to the hollow wheel 26.

Although the hill and recess features have been described as being part of the hollow wheel 26 (e.g., as fabricated onto the hollow wheel or as a wave washer secured to the hollow wheel), in some embodiments, the hills and recesses are part of the transmission element 25.

The hollow wheel 26 rotates about the axis 20 relative to the punch shaft 22 and the tool guide 23. To support rotation, the hollow wheel 26 includes circular tracks around the axis 20 which have semi-circular cross sections on the upper side of the hollow wheel 26 and on the lower side of the hollow wheel 26.

Still referring to FIG. 2*a*, for supporting the hollow wheel 26 between the punch shaft 22 and the tool guide 23, multiple first rolling elements 27 are provided in the form of balls (e.g., ball bearings) to roll in the circular tracks between the upper side of the hollow wheel 26 and the lower side of the punch shaft 22 and between the lower side of the hollow wheel 26 and the upper side of the tool guide 23, respectively.

Between the shoulder of the hollow wheel 26 and the transmission element 25, a plurality of second rolling elements 28 are arranged. The second rolling elements 28 are typically evenly distributed around the shoulder of the hollow wheel 26 to correspond to the distribution of the hills and recesses formed around the hollow wheel 26. In some cases, the lower surface of the shoulder is relatively flat. The second rolling elements 28 contact the upper surface of the shoulder of the hollow wheel 26 and roll along the shoulder of the hollow wheel 26.

Above the transmission element 25, an elastic element 29 (e.g., a compression spring) is provided centrally within the cylindrical recess of the punch shaft 22 in the direction of the axis 20. As shown, the compression spring 29 is positioned between the upper end of the cylindrical recess and the transmission element 25, and provides a force to each of the components.

A second elastic element 30 in the form of a compression spring is positioned between the lower side of the shoulder of the tool insert 24 and the shoulder which is formed at the lower end of the cylindrical recess in the tool guide 23. As shown in FIG. 2*a*, the compression spring 30 pushes the tool insert 24 upward against the web 39 of the transmission element 25 so that the tool insert 24 is located at a defined position abutting against the web 39. In some cases, the spring 30 is designed such that the tool insert 24 abuts against the web 39, even when the tool insert 24 or the web 39 undergoes dynamic forces while in motion.

In some embodiments, during use, the tool 41 is received in the upper tool holding fixture 12 of the ram 10 (shown in FIG. 1) and the ram 10 can travel about a predetermined stroke so that a predetermined distance is adopted between the lower side of the tool guide 23 and the upper side of the sheet metal workpiece 9 at the intersection point of the axis 20 and the sheet metal workpiece 9 to be machined. The distance can be determined such that the lower end of the tool insert 24 penetrates the sheet metal workpiece 9 to a defined depth. In some embodiments, the upper tool holding fixture 12 is put into rotation with a rotational speed of up to 600 rpm so that the tool 41, except the locked hollow wheel 26, rotates with this rotational speed. As a result, in some cases, a frequency of the oscillating movement of the tool insert 24 of about 6000 oscillations per minute can be reached due to the low moved masses.

Optionally, the distance between the tool 41 and the sheet metal workpiece 9 can be determined or detected by a detection device and the ram 10 can be moved away from the sheet metal workpiece 9 or moved toward the sheet metal workpiece 9 such that the distance can remain constant when the sheet metal workpiece 9 is moved to a new position of machining.

In some embodiments, the hollow wheel 26 can be locked by a locking device 15 shown in FIG. 1. In such embodiments, a rotational movement can be created between the hollow wheel 26 and the punch shaft 22, the tool guide 23, and the transmission element 25 which can be rotatably coupled to each other so that they can rotate relative to the hollow wheel 26. Therefore, due to frictional forces between the surfaces of the second rolling elements 28 and the surfaces contacted by them, the second rolling elements 28 roll between the lower side of the downwardly extending shoulder of the transmission element 25 and the upper annulus surface of the shoulder in the hollow wheel 26 when the transmission element 25 and the hollow wheel 26 rotate relative to each other. The second rolling elements 28 are forced against the annulus surface of the shoulder by the transmission element 25 due to the downward force exerted onto the transmission element 25 by the spring 29. Because the surface of the shoulder is not uniform or flat but circumferentially wave-like, the second rolling elements 28 do not only circularly move around the axis 20 but they also move up and down in the direction of the axis 20 due to the second rolling elements 28 rolling along the wave-like surface of the shoulder. Since the second rolling elements 28 are in contact with the transmission element 25, the up and down movement of the second rolling elements 28 can generate an oscillating movement of the transmission element 25 which transmits this movement to the tool insert 24.

During operation, the dynamic inertial forces could cause the transmission element 25 to lose contact with the second rolling elements 28 which could result in a loss of oscillating movement. Therefore, a preload force is applied by the spring 29 that serves to maintain a normal force between the second rolling elements 28 and the surfaces contacted in order to maintain the frictional force typically needed to keep the second rolling bodies 28 rolling.

The number of the strokes of the tool insert 24 can be determined by the rotational speed of the rotating tool holding fixture 12 and the number of hills and recesses on the surface of the shoulder of the hollow wheel 26.

Alternatively to the rotation of the upper tool holding fixture 12 and the punch shaft 22 combined with the locking of the hollow wheel 26, in some embodiments, the upper tool holding fixture 12 with the punch shaft 22 can be locked and the hollow wheel 26 can be rotated by a second upper rotary drive. In such embodiments, the oscillating movement can be achieved by utilizing the methods discussed above (e.g., using wave-like surfaces).

In some embodiments, the punch shaft 22 and the transmission element 25 are rotated by the first rotary drive in one direction and the hollow wheel 26 is rotated by the second upper rotary drive in the opposite direction of the punch shaft 22 and the transmission element 25. Due to the different directions of rotation, a difference in rotational speed occurs between the transmission element 25 and the hollow wheel 26. Therefore, by controlling the rotational speeds of the first rotary drive and the second upper rotary drive, the frequency of the oscillating movement of the tool insert 24 can be controlled.

Due to the arrangement of the compression spring 29, such that the compression spring 29 exerts a downward force onto the transmission element 25 and the shoulder of the hollow wheel 26, the compression spring 29 effects the upward movement of the transmission element 25 and therefore the force for impressing the tool insert 24 into the sheet metal workpiece 9 is exerted only by the spring 29. Therefore, the force provided to the tool insert 24 is limited to the force of the spring 29 which reduces the risk of damage of the tool when collisions between the tool insert 24 and the sheet metal workpiece 9 or other obstacles can occur; however, it also limits the force for machining the sheet metal workpiece 9.

When the tool 41 is received by the upper tool holding fixture 12, as discussed above, the lower tool holding fixture 13 can include a substantially flat horizontal surface.

In some embodiments, the lower tool holding fixture includes a movable roller or a movable ball, on which the sheet metal workpiece 9 is supported in order to avoid scratching the lower side of the sheet metal workpiece 9.

Alternatively, in other embodiments, the tool 41 is designed such that it is received by the lower tool holding fixture 13 (shown in FIG. 1). In such embodiments, the tool 41 can be rotated by the lower tool holding fixture 13 and the rotary drive 16 to which the lower tool holding fixture 13 is connected. When the tool 41 is positioned in the lower tool holding fixture 13, the upper holding fixture 12 can include a substantially flat, horizontal surface.

Figure 3:
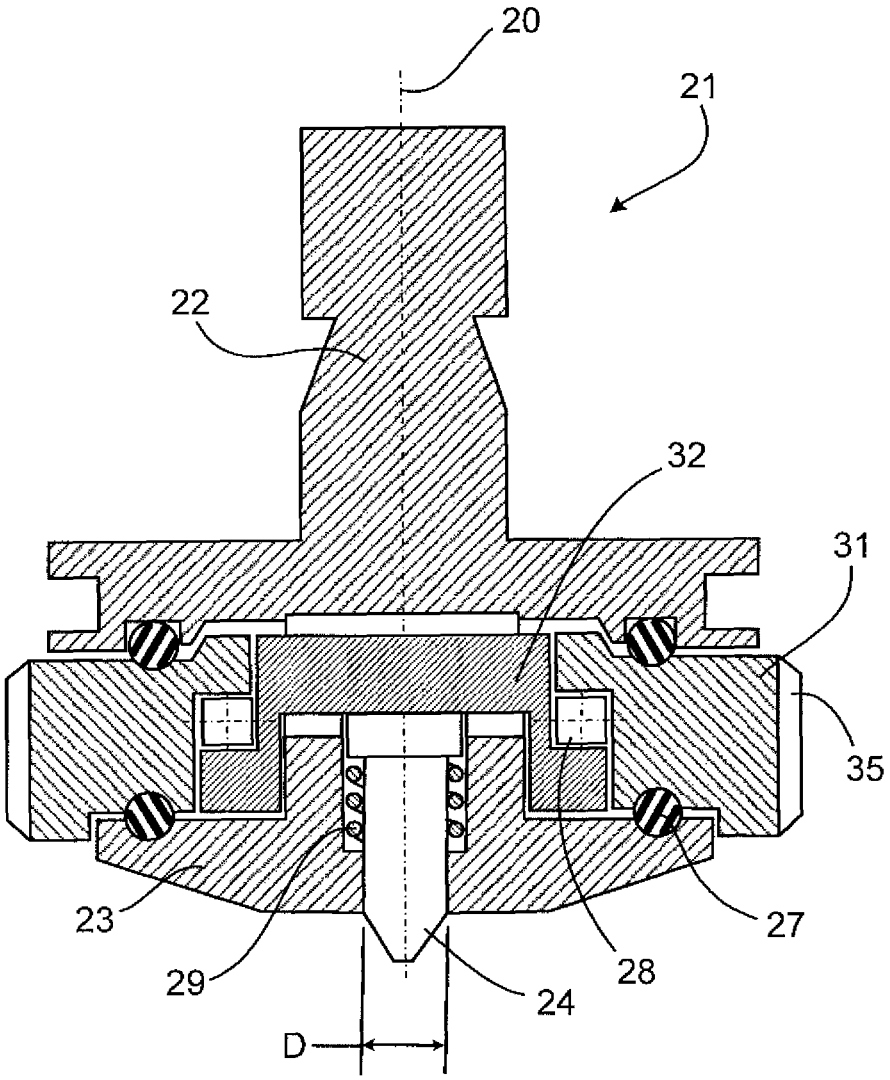
FIG. 3 is a schematic diagram illustrating a cross-sectional view of the tool with the oscillating tool insert.

As shown in FIG. 3, in some embodiments, a tool 21 with an oscillating tool insert includes a substantially similar structure to achieve the substantially similar function as the tool 41 (discussed above and shown in FIG. 2*a*), wherein the preload force of the spring 29 is exerted in the opposite direction as the spring used in the tool 41. In such embodiments, the tool 21 includes a hollow wheel 31 and a transmission element 32 that are different than the transmission element 25 and the hollow wheel 26 used in the tool 41. Due to the similar operation, the other components of the tool 21 are generally the same as the corresponding components used in the tool 41.

The hollow wheel 31 includes a shoulder along its upper region and the surface of the shoulder includes hills and recesses are directed downward from the shoulder.

The transmission element 32 is not formed to be substantially disc-shaped, as in the transmission element 25 described above, but instead is shaped like an upside down pot, such that the bottom of the pot is located at the upper end of the transmission element 32. Semi-circular segment-like notches similar to those in the transmission element 25 (shown in FIG. 2*a*) are formed along the surface of the bottom of the pot, (although they are not shown in FIG. 3). Due to the notches, the bottom of the pot also includes a centrally located web (shown in FIG. 3 to be a cross section), whereby by a form-fit connection of the punch shaft 22 and the tool guide 23 with the transmission element 32 is created. An outer circumferential rim at the lower end of the transmission element 32 can include a running surface for the second rolling elements 28.

The first elastic element 29 (e.g., a spring) is provided between the inner lower shoulder of the cylindrical recess in the tool guide 23 and the shoulder in the tool insert 24. The spring 29 provides an upward force onto the tool insert 24 so that the tool insert 24 abuts at the transmission element 32. Due to the force of the spring 29 which pushes the tool insert 24 upward to abut the transmission element 32, the transmission element 32 is pushed upward onto the second rolling elements 28 and thus an upward force is provided to the hollow wheel 31.

In some embodiments, during use, the second rolling elements 28 roll due to a frictional engagement with the upper surface of the circumferential rim of the transmission element 32 and the lower wave-like surface of the shoulder of the hollow wheel 31.

Due to the form-fit power flux from the punch ram 10 to the tool insert 24, the force exerted to the sheet metal workpiece 9 in the embodiment shown in FIG. 3 corresponds to the force provided by the punching machine which downwardly moves the punch ram 10. Therefore, such force provided by the punching machine 1 to the punch ram 10 is typically larger than the force that can exerted by the spring 29.

In some embodiments, for marking the sheet metal workpiece 9 or other materials on punching machines 1, the tool insert 24 with a tapered lower end including a tip is used. By using tool inserts 24 with lower ends having different shapes, such as an end including a radius at least in one plane (e.g., rounded), beads can be formed into the sheet metal workpiece 9. Also, further machining of the sheet metal workpiece 9 can be performed due to the larger forces that can be exerted, in particular, when using the tool 21 described above with regards to FIG. 3.

In some embodiments, the tool insert 24 is made of hardened tool steel materials or of cemented carbide materials.

In some embodiments, the oscillating movement of the drive mechanism is caused by an electrical drive integrated in the tool. In some cases, the mechanical principle of the drive mechanism remains utilized and a rotary drive movement of the electrical drive is transformed into a linear oscillating movement. In such cases, the drive is formed as an electric motor, where the several subassemblies can be integrally formed within the elements of the tool.

In other cases, the drive is operated by using magnets (e.g., electromagnets) integrated in the tool. In such cases, the magnets can cause the oscillating movement of the tool insert 24 by appropriate arrangement in the tool and selective activation.

In some embodiments, the control and the supply of the electrical drives in the form of the electric motor or the magnets are driven by the controller of the punching machine 1 using suitable transmission means.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A tool for a punching machine, the tool comprising:

a portion to be received in a tool holding device of the punching machine; and a tool insert movably supported in the portion of the tool in a manner such that the tool insert can be moved relative to the portion of the tool in a direction of a longitudinal axis of the tool, wherein the portion of the tool comprises a drive mechanism to move the tool insert in an oscillating manner, and the drive mechanism comprises:

a hollow wheel having a circumferential gearing for driving the drive mechanism, a transmission element which is circumferentially surrounded by the hollow wheel, wherein one of the hollow wheel and the transmission element has a surface having hills and recesses, and rolling elements axially arranged between the hollow wheel and the transmission element for generating an oscillating movement of the transmission element.

2. The tool according to claim 1, wherein the drive mechanism comprises an element rotatably supported about the longitudinal axis of the tool, and a mechanical device to convert a rotary movement of the element about the longitudinal axis of the tool into an oscillating movement of the tool insert.

3. The tool according to claim 2, wherein the mechanical device comprises at least one element having an undulating active area, a transmission element for transmitting the oscillating movement to the tool insert, and at least one preload element to apply a force to the transmission element in the direction of the active area.

4. The tool according to claim 3, further comprising a plurality of rolling elements arranged between the undulating active area and the transmission element.

5. The tool according to claim 1, further comprising an integrated electrical drive that is connected to the drive mechanism in a manner to allow the electrical drive to drive the drive mechanism.

6. The tool according to claim 1, wherein the tool insert has a lower end portion that is configured to machine a workpiece when the tool insert is oscillated.

7. The tool according to claim 6, wherein the lower end portion comprises a tapered end.

8. The tool according to claim 6, wherein the tool insert is pin-shaped.

9. A punching machine comprising:

a tool holding device;

a device for operating a drive mechanism of a tool, the tool comprising:

a portion configured to be received in the tool holding device of the punching machine;and a tool insert movably supported in the portion of the tool in a manner such that the tool insert can be moved relative to the portion of the tool in a direction of a longitude axis of the tool, wherein the portion of the tool comprises a drive mechanism to move the tool insert in an oscillating manner; and the drive mechanism comprises:

a hollow wheel having a circumferential gearing for driving the drive mechanism using the device for operating the drive mechanism, a transmission element circumferentially surrounded by the hollow wheel, wherein one of the hollow wheel and the transmission element has a surface having hills and recesses, and rolling elements axially arranged between the hollow wheel and the transmission element for generating an oscillating movement of the transmission element.

10. The punching machine according to claim 9, further comprising a driving device for rotating the portion of the tool to be received in a tool holding device of the punching machine.

11. The punching machine according to claim 9, further comprising a locking device for locking the drive mechanism of the tool.

12. The punching machine according to claim 9, further comprising a driving device for rotating the drive mechanism of the tool.

13. The punching machine according to claim 9, wherein the punching machine comprises a machine controller, and the tool holding device is configured to be translated to a predetermined stroke position, by being activated by the machine controller.

14. The punching machine according to claim 13, wherein the machine controller is adapted to set a predetermined stroke position such that the distance between a workpiece to be machined and the portion of the tool is constant during translation of the workpiece.

15. The punching machine according to claim 9, wherein the tool further comprises an integrated electrical drive connected to the drive mechanism, and the punching machine supplies the integrated electrical drive of the tool with electrical power.

* * * * *

UNITED STATES PATENT AND TRADEMARK OFFICE

CERTIFICATE OF CORRECTION

PATENT NO. : 8,839,654 B2
APPLICATION NO. : 13/164304
DATED : September 23, 2014
INVENTOR(S) : Werner Erlenmaier It is certified that error appears in the above-identified patent and that said Letters Patent is hereby corrected as shown below:

On the title page item (75), after "Werner Erlenmaier", delete "Garlingen (DE)" and insert --Gerlingen (DE)--.

Signed and Sealed this
Fourteenth Day of April, 2015

Michelle K. Lee

Michelle K. Lee
*Director of the United States Patent and Trademark Office*